US008089016B2

(12) United States Patent
Dahl et al.

(10) Patent No.: US 8,089,016 B2
(45) Date of Patent: Jan. 3, 2012

(54) CIRCUIT BREAKER, IN PARTICULAR FOR LOW VOLTAGES

(75) Inventors: Jörg-Uwe Dahl, Werder (DE); Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 317 days.

(21) Appl. No.: 12/461,638

(22) Filed: Aug. 19, 2009

(65) Prior Publication Data

US 2010/0044196 A1 Feb. 25, 2010

(30) Foreign Application Priority Data

Aug. 20, 2008 (DE) ..... 10 2008 039 187

(51) Int. Cl.
*H01H 5/00* (2006.01)

(52) U.S. Cl. ..... 200/400

(58) Field of Classification Search ..... 200/400, 200/244, 248, 275, 243, 17 R; 218/22, 146, 218/30–33; 335/16, 147, 195
See application file for complete search history.

(56) References Cited

U.S. PATENT DOCUMENTS

| | | | | |
|---|---|---|---|---|
| 5,310,971 | A | 5/1994 | Vial et al. | |
| 5,313,180 | A | 5/1994 | Vial et al. | |
| 6,114,641 | A * | 9/2000 | Castonguay et al. | 200/244 |
| 7,005,594 | B2 * | 2/2006 | Kim | 200/244 |
| 7,189,935 | B1 * | 3/2007 | Hassan et al. | 200/244 |
| 7,221,246 | B2 * | 5/2007 | Rajauria et al. | 335/16 |
| 7,977,592 | B2 * | 7/2011 | Shmukler et al. | 200/244 |
| 2007/0251809 | A1 | 11/2007 | Handler et al. | |

FOREIGN PATENT DOCUMENTS

| | | |
|---|---|---|
| DE | 693 02 610 T2 | 11/1996 |
| DE | 693 04 374 T2 | 2/1997 |
| DE | 100 56 816 A1 | 5/2002 |
| DE | 100 56 818 A1 | 5/2002 |
| DE | 100 56 820 A1 | 5/2002 |
| DE | 100 56 821 A1 | 5/2002 |
| DE | 101 50 550 C1 | 12/2002 |
| DE | 103 47 148 A1 | 5/2005 |
| DE | 103 58 828 A1 | 7/2005 |

* cited by examiner

*Primary Examiner* — Edwin A. Leon
(74) *Attorney, Agent, or Firm* — Harness, Dickey & Pierce, P.L.C.

(57) ABSTRACT

A circuit breaker is disclosed, in particular for low voltages, with moving and fixed contacts, a switching shaft and a contact lever. The contact lever is rotatably mounted on or in the switching shaft, and includes a free end that extends from the switching shaft, carries the contact piece of the moving contact on one side of its external contour and has a first depression on the other opposite side of the external contour for engaging a bolt. In at least one embodiment, the contact lever is subjected to a torsional moment in the closing direction by means of the bolt in each case. To ensure opening, it is proposed that a second depression be provided at a distance from the first depression, that a slot-shaped recess be formed on the switching shaft, that the contact lever, in the event of a trip, moves the bolt towards the side wall of the recess which lies in the direction of movement, which pushes the bolt out of the first depression into the second depression, the depth of which is such that the bolt lies on the bottom of the recess, which rises radially in the closing direction in such a way that a counter force must be overcome in order to rotate the contact lever in the closing direction.

17 Claims, 5 Drawing Sheets

CIRCUIT BREAKER, IN PARTICULAR FOR LOW VOLTAGES

PRIORITY STATEMENT

The present application hereby claims priority under 35 U.S.C. §119 on German patent application number DE 10 2008 039 187.5 filed Aug. 20, 2008, the entire contents of which are hereby incorporated herein by reference.

FIELD

At least one embodiment of the invention generally relates to a circuit breaker, in particular for low voltages.

BACKGROUND

Circuit breakers for low voltages are generally known. A double contact lever, for example, which is provided at its free ends with contact pieces which each form the moving contact, is used to open and close the circuit breaker. The contact pieces of the moving contacts lie opposite a contact piece of a fixed contact in each case. The contact lever is rotatably mounted in a switching shaft and extends perpendicular to the longitudinal axis thereof, wherein its ends protrude from the switching shaft. The contact piece of the moving contact is mounted on one side of the external contour while a depression is provided on the opposite side in which a bolt extending parallel to the switching shaft is engaged.

The elastic forces of a pair of springs, the torsional moment of which pulls the contact lever in the closing direction and holds the double contact lever in its closed position, act on both ends of the bolt. The current through the circuit breaker flows via the contact lever and the two current feeds which are designed in the form of conductor loops. When a short circuit occurs, large electromagnetic forces are produced in the conductor loops and move the double contact lever into its open position. At the same time, it is necessary that the contact pieces separate relatively quickly in order to interrupt the current flow as quickly as possible but without the contact lever falling back into its closed position after opening.

Preventing the contact lever falling back by pulling the bolt into a latching notch has already been disclosed in DE 693 04 374 T2 (FR 2 688 626), the entire contents of which are hereby incorporated herein by reference. In doing so, the energy required to latch the bolt is taken from the kinetic energy of the contact lever, which in turn slows down the switch opening. The latching notch is part of a control contour (control cam), which because of its radial elevation in the region of the latching notch inhibits the movement of the bolt and therefore that of the contact lever in the closing direction, as it is associated with a corresponding counter moment which must first be overcome by the bolt. This prevents an unwanted falling back (reclosing) of the circuit breaker.

SUMMARY

In at least one embodiment of the invention a circuit breaker is proposed with a contact lever which opens reliably in the event of a short circuit.

In at least one embodiment a solution envisages that a second depression be provided on the same side of the external contour towards the free end at a distance from the first depression, that a slot-shaped recess be formed on the switching shaft, that the contact lever, which rotates in the opening direction in the event of a trip, moves the bolt towards the side wall of the recess which lies in the direction of movement, which, after coming into contact therewith as the contact lever continues to rotate, pushes the bolt out of the first depression into the second depression, the depth of which is such that after latching into the second depression the bolt lies on the bottom of the recess, which rises radially in the closing direction in such a way that a counter force must be overcome in order to move the contact lever in the closing direction. The bolt is lowered to a lower plateau and therefore the contact lever only has a counter moment to overcome on reclosing.

A technically simple design is when the second depression is radially deeper than the first.

The circuit breaker can easily be returned to the ready condition if the side wall of the slot-shaped recess facing the opening direction forms a second stop, which is opposite the first stop and finally pushes the bolt back into the first depression when the switching shaft rotates in the opening direction of the contact lever.

BRIEF DESCRIPTION OF THE DRAWINGS

The invention is described in more detail below with reference to an example embodiment. In the drawing.

DETAILED DESCRIPTION OF THE EXAMPLE EMBODIMENTS

Figure 1:
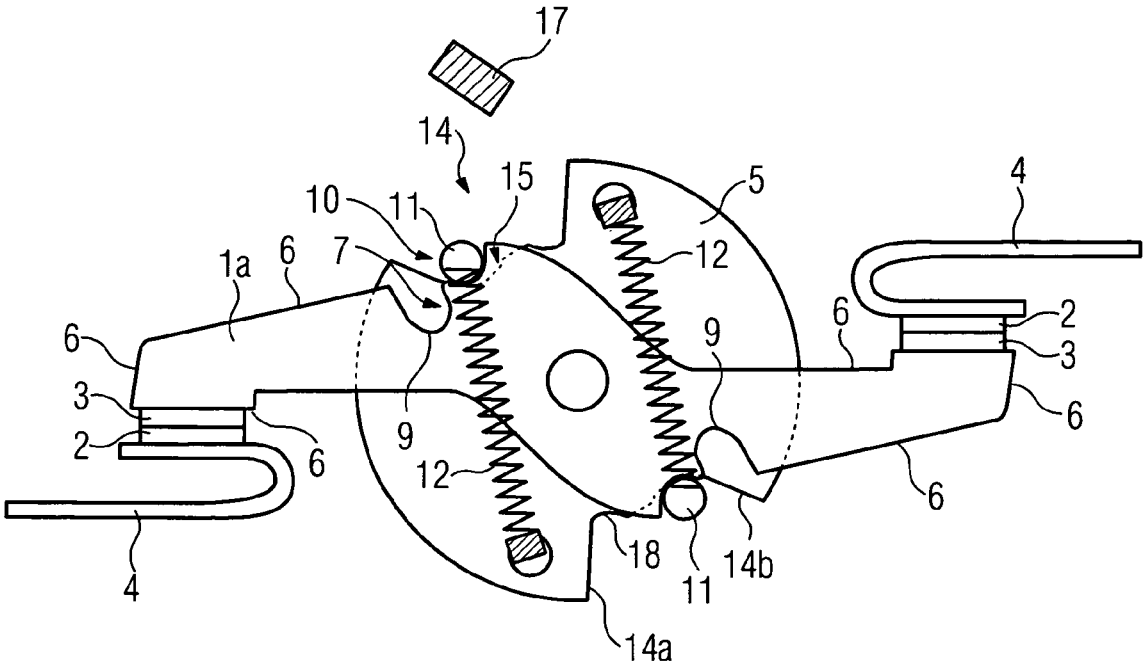
FIG. 1 to 5 show four consecutive snapshots of the movement of a contact lever from its closed position to its open position.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a section of a closed circuit breaker for low voltages, which has a rotatably mounted contact lever 1 for opening and closing in the form of a double lever 1*a*. At each of its free ends, the contact lever 1 carries a contact piece 2, which point in opposite directions and form the moving contacts of the circuit breaker. Contact pieces 3 of a fixed contact, against which the contact pieces 2 rest in FIG. 1, are arranged opposite each of the contact pieces 2, as the contact lever 1 in FIG. 1 is shown in its closed position. The contact pieces 3 are attached to fixed conductor loops 4 which act as current feeds. The ends of the conductor loops 4 are provided with connecting terminals (not shown) for connecting the circuit breaker.

When the circuit breaker is closed, the current flows from the one conductor loop 4 via the associated contact pieces 2, 3, the contact lever 1 and the contact pieces 3, 2 to the other conductor loop 4.

The contact lever 1 is rotatably mounted in a switching shaft 5 (or a switching shaft segment). Running perpendicular to its longitudinal direction, the switching shaft 5 has a through opening through which the contact lever 1 extends, wherein both ends of the contact lever 1 protrude from the switching shaft 5 as shown in FIG. 1. On one side of its external contour 6, each end carries a contact piece 3 and, on the opposite side of the same end, has a control contour 7 with two depressions 8, 9 (first and second depression 8 and 9 respectively). In FIG. 1, a bolt 10 (latching bolt), which is aligned parallel to the switching shaft 5, is engaged in the depression 8. A spring 12, which applies a torsional moment to the contact lever 1 in the closing direction, is fixed to each of the two ends 11 of the bolt 10. For this purpose, the other end of the spring 12 is engaged in an appropriate opening 13 on the switching shaft 5.

According to the design in the form of a double lever, the control contour 7, the bolt 10 and the springs 12 are provided once at each of the two ends and, in addition, are arranged symmetrically with respect to the axis of rotation of the contact lever 1, which here coincides with the longitudinal axis and axis of rotation of the switching shaft 5.

As in each case a spring 12 acts at both ends of each bolt 10, the springs 12 are present in pairs on both sides of the contact lever 1. FIG. 1 shows the view on one of these two sides.

As can be seen from FIG. 1, recesses 14, which are arranged symmetrically with respect to one another and extend in the form of slots in the longitudinal direction of the switching shaft 5, are present on the switching shaft 5. The cross sectional shape of the recess 14 likewise forms a control contour 15 (switching shaft control contour), which acts together with the control contour 7 (contact lever control contour).

Figure 2A:
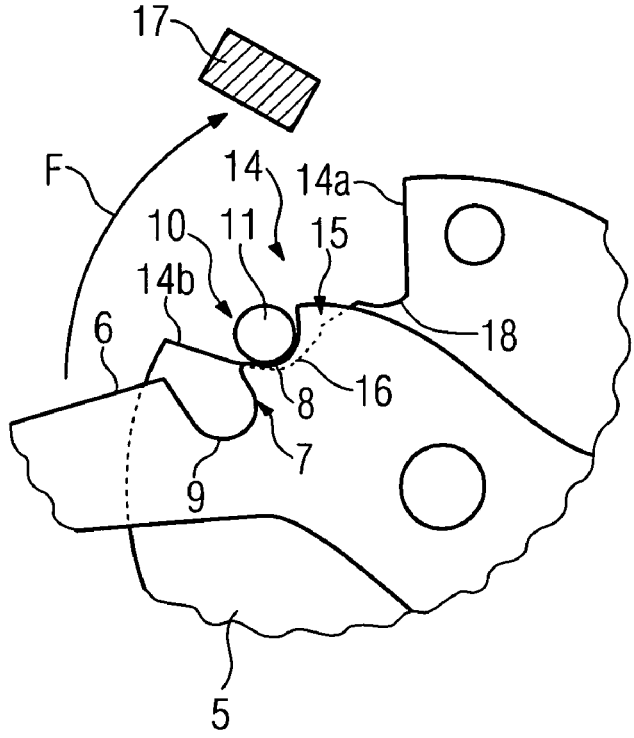
Figure 2B:
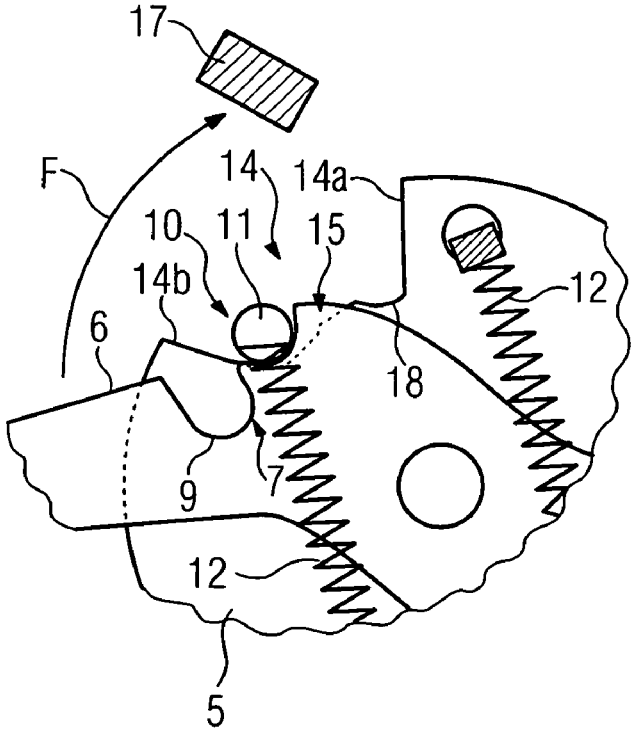

FIGS. 2A and 2B show a section of the two control contours 7 and 15 of FIG. 1 in an enlarged view, wherein only the springs 12 have been omitted from FIG. 2A for better clarity. The two depressions 8, 9 of the control contour 7 can be seen rather more clearly. A depression 16 of the switching shaft control contour 15 is located in the region of the depression 8 of the contact lever control contour 7. This depression 16 of the switching shaft is formed so that the bolt 10 is supported solely on the contact lever 1 in the closed position.

In the event of a trip, that is to say when a short circuit current occurs, a magnetic field is generated by the conductor loops 4 which moves the contact lever 1 accelerating in the direction of the arrow F until it finally comes into contact with the stop 17. At the same time, the bolt 10 located in the depression 8 initially moves towards the side wall 14*a* before, after coming into contact therewith as the contact lever 1 continues to rotate, it is pushed thereby (by the side wall 14*a*) out of the depression 8, an (as small as possible) resistance must be overcome (the springs 12 being pushed further apart and thereby further tensioned) in order to be then pulled into the depression 9 as a result of the effective spring force of the springs 12. Energy, which must be taken from the kinetic energy of the contact lever 1, is therefore required to latch the bolt 10 in the depression 9. This is shown in FIG. 3-5, wherein FIG. 5 shows the contact lever 1 in its right-hand end position, its open position.

With regard to its depth, the depression 9 of the contact lever control contour 7 is designed so that, in the open position of the contact lever 1 (see FIG. 5), after engaging in the depression 9, the bolt 10 does not rest on the bottom thereof but on the bottom of the recess 15 (see FIG. 2), i.e. the bolt 10 is supported only on the switching shaft 5 and therefore no longer exerts a torsional moment on the contact lever 1. In other words, as a result of the deeper depression 9, the bolt 10 remains resting on the switching shaft 5 in the region 18, which forms a kind of latching plateau for the bolt 10 in this area. The bolt 10 is effectively deposited on the latching plateau in the region 18; resting on this latching plateau it therefore no longer exerts a torsional moment on the contact lever 1 in the region 18.

A slight depression is formed in the region 18. As can be seen, the region 18—referring to FIG. 2—rises slightly to the left so that a counter force, which holds the bolt 10 on the bottom of the recess 15 in each case, has to be overcome in order to move the bolt 10 to the left.

Figure 3:
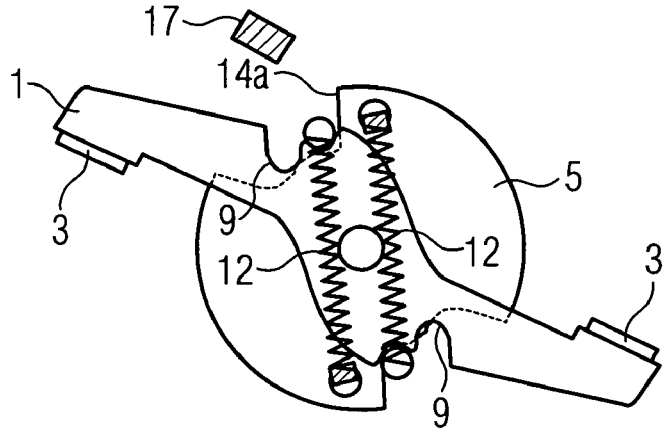
Figure 4:
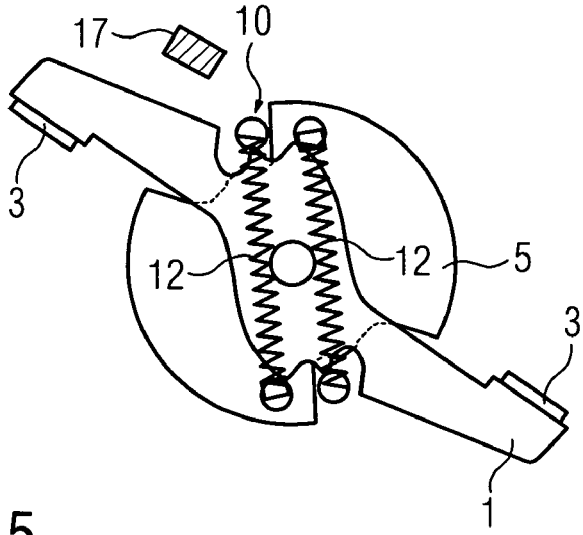
Figure 5:
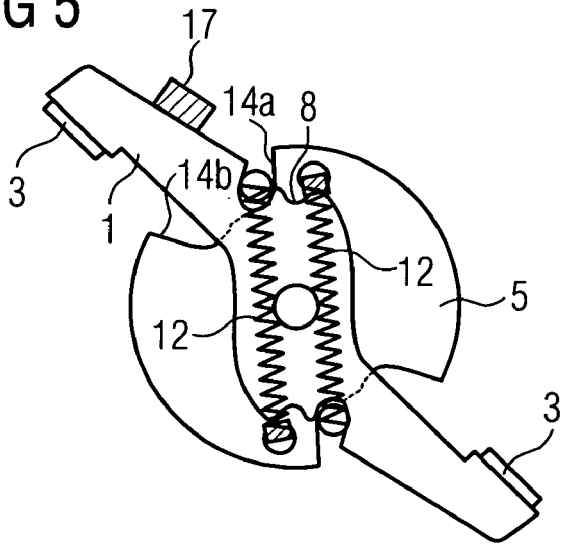
Figure 6:
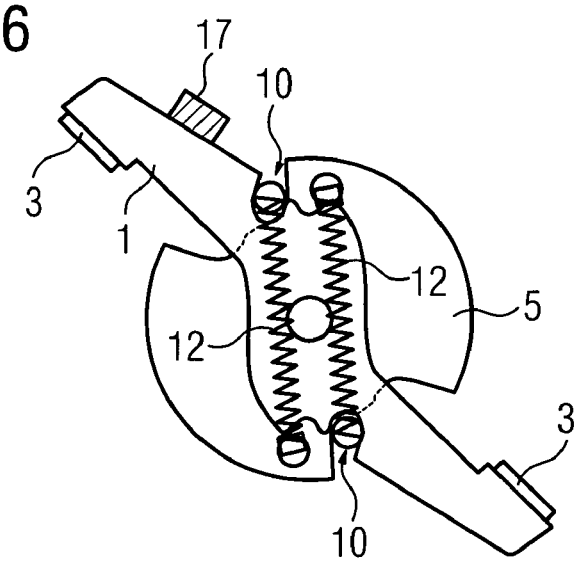
FIG. 6 to 11 show six snapshots of the movement of the switching shaft to the point where the switched-on position is re-established.
Figure 7:
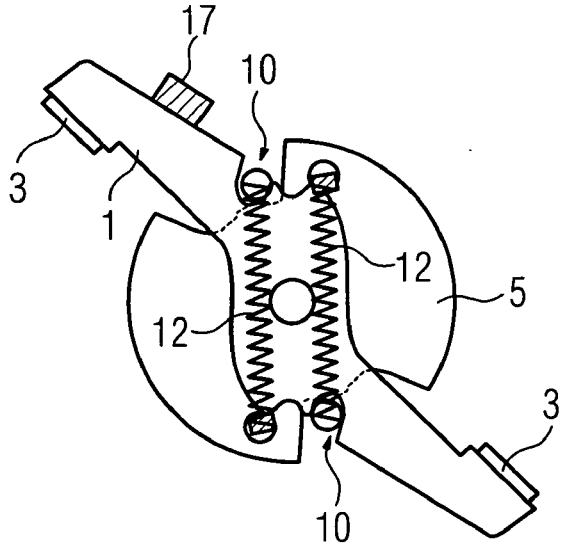
Figure 8:
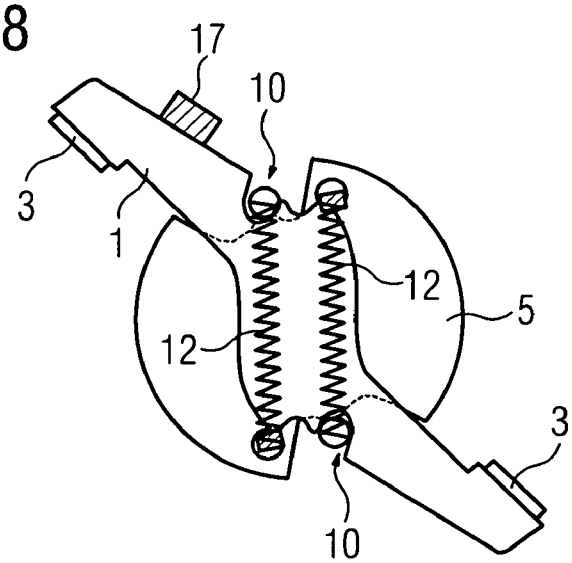
Figure 9:
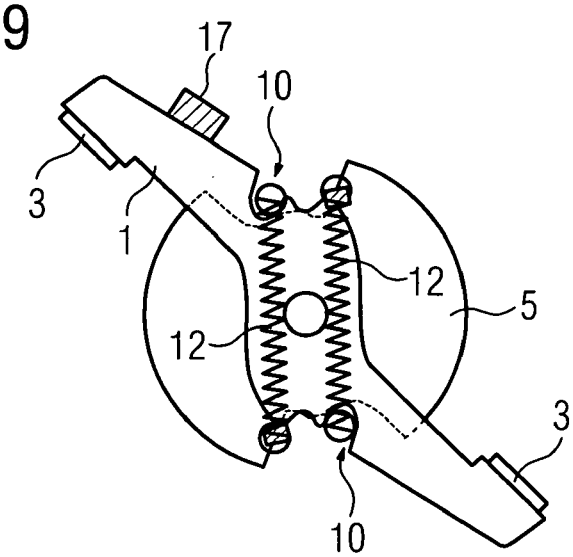
Figure 10:
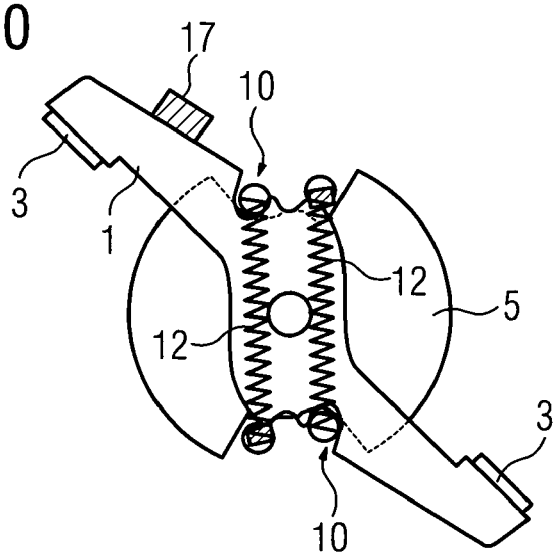
Figure 11:
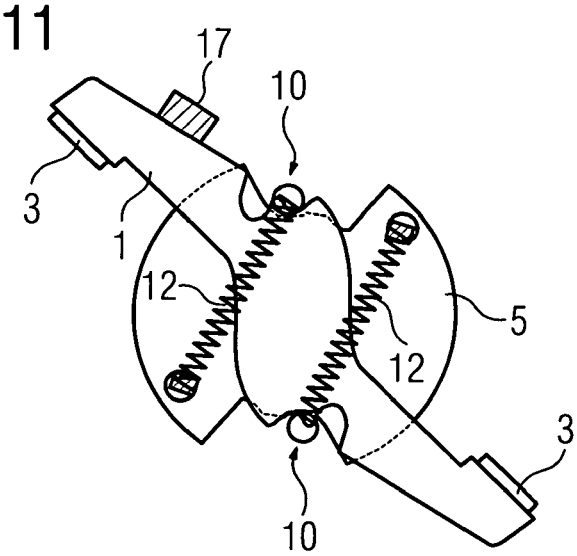

FIG. 3-5 show the defined "jump" of the bolt 10 from the depression 8 into the radially deeper depression 9, wherein only the friction between bolt 10 and control contour 7 (contact lever 1) is to be overcome. The control contour 7 with the depressions 8, 9 thus enables reliable positioning and also a resistance-free and reliable change to the engagement position of the bolt 10.

With multi-pole switches, the contact levers 1 of the phases not affected by the short circuit are also opened. This is shown in FIG. 6-11, which show that, as the switching shaft 5 rotates appropriately, each bolt 10 is pushed from the depression 9 back into the depression 8 by the other side wall 14*b* of the slot-shaped depression 16 (FIG. 5 and FIG. 6 being identical in this regard). With this switching process, each contact lever 1 remains in its open position in each case due to its inertia.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A circuit breaker, comprising:

a moving and a fixed contact with contact pieces which face one another for opening and closing;

a switching shaft including a slot-shaped recess formed on the switching shaft; and a contact lever, the contact lever being rotatably mounted on or in the switching shaft and extending perpendicular to a longitudinal axis of the switching shaft, a free end of the contact lever extending from the switching shaft, carrying the contact piece of the moving contact on one side of an external contour of the contact lever, and including a first depression on an opposite side of the external contour for engaging a bolt which extends along the switching shaft, the contact lever being subjected to a torsional moment in a closing direction by way of the bolt in each case and including a second depression on a same side of the external contour towards the free end at a distance from the first depression, the contact lever, which rotates in an opening direction in an event of a trip, moving the bolt towards the side wall of the recess of the switching shaft which lies in the direction of movement, which, after coming into contact therewith as the contact lever continues to rotate, pushes the bolt out of the first depression into the second depression, the depth of which is such that after latching into the second depression, the bolt lies on the bottom of the recess, which rises radially in a closing direction in such a way that a counter force must be overcome in order to rotate the contact lever in the closing direction.

2. The circuit breaker as claimed in claim 1, wherein the second depression is radially relatively deeper than the first depression.

3. The circuit breaker as claimed in claim 1, wherein the side wall of the slot-shaped recess facing the opening direction forms a second stop, which is opposite a first stop and finally pushes the bolt back into the first depression when the switching shaft rotates in the opening direction of the contact lever.

4. The circuit breaker as claimed in claim 1, wherein the circuit breaker is for low voltages.

5. The circuit breaker as claimed in claim 2, wherein the side wall of the slot-shaped recess facing the opening direction forms a second stop, which is opposite the first stop and finally pushes the bolt back into the first depression when the switching shaft rotates in the opening direction of the contact lever.

6. The circuit breaker as claimed in claim 4, wherein the second depression is radially relatively deeper than the first depression.

7. The circuit breaker as claimed in claim 4, wherein the side wall of the slot-shaped recess facing the opening direction forms a second stop, which is opposite a first stop and finally pushes the bolt back into the first depression when the switching shaft rotates in the opening direction of the contact lever.

8. The circuit breaker as claimed in claim 6, wherein the side wall of the slot-shaped recess facing the opening direction forms a second stop, which is opposite a first stop and finally pushes the bolt back into the first depression when the switching shaft rotates in the opening direction of the contact lever.

9. A circuit breaker, comprising:

a moving and a fixed contact with contact pieces which face one another for opening and closing;

a switching shaft including a slot-shaped recess formed on the switching shaft; and a contact lever, the contact lever being rotatably mounted on or in the switching shaft and including a first depression for engaging a bolt which extends along the switching shaft and a second depression, the contact lever being movable to move the bolt towards a side wall of the slot-shaped recess of the switching shaft, which, after coming into contact therewith as the contact lever continues to rotate, pushes the bolt out of the first depression into the second depression, wherein after latching into the second depression, the bolt lies on the bottom of the recess such that a counter force must be overcome in order to rotate the contact lever in the closing direction.

10. The circuit breaker as claimed in claim 9, wherein the second depression is radially relatively deeper than the first depression.

11. The circuit breaker as claimed in claim 9, wherein a side wall of the slot-shaped recess forms a stop which pushes the bolt back into the first depression when the switching shaft rotates in the opening direction of the contact lever.

12. The circuit breaker as claimed in claim 9, wherein the circuit breaker is for low voltages.

13. The circuit breaker as claimed in claim 10, wherein a side wall of the slot-shaped recess forms a stop which pushes the bolt back into the first depression when the switching shaft rotates in the opening direction of the contact lever.

14. The circuit breaker as claimed in claim 12, wherein the second depression is radially relatively deeper than the first depression.

15. The circuit breaker as claimed in claim 12, wherein a side wall of the slot-shaped recess forms a stop which pushes the bolt back into the first depression when the switching shaft rotates in the opening direction of the contact lever.

16. The circuit breaker as claimed in claim 14, wherein a side wall of the slot-shaped recess forms a stop which pushes the bolt back into the first depression when the switching shaft rotates in the opening direction of the contact lever.

17. The circuit breaker as claimed in claim 9, wherein the contact lever is subjected to a torsional moment in a closing direction by way of the bolt and wherein the contact lever rotates in an opening direction in an event of a trip.

* * * * *